US006161562A

United States Patent [19]

Keefer et al.

[11] Patent Number: 6,161,562

[45] Date of Patent: Dec. 19, 2000

[54] DRAW AND RETURN TUBE ASSEMBLY AND PROCESS OF MANUFACTURING THE SAME

[76] Inventors: Neal L. Keefer, 4025 NE. Couch St., Portland, Oreg. 97232; Kenneth A. Watson, 1100 NE. 126$^{th}$ St., Vancouver, Wash. 98685

[21] Appl. No.: 09/419,225

[22] Filed: Oct. 15, 1999

[51] Int. Cl.$^{7}$ ..... F02B 27/00

[52] U.S. Cl. ..... 137/15.08; 137/343; 137/590; 137/592; 285/158

[58] Field of Search ..... 137/590, 592, 137/343, 15.08; 251/143, 144; 123/469; 285/158

[56] References Cited

U.S. PATENT DOCUMENTS

| | | | |
|---|---|---|---|
| 2,125,674 | 8/1938 | Gould | 137/590 |
| 2,870,786 | 1/1959 | Schroeder | 137/590 |
| 3,500,858 | 3/1970 | Metcalf | 137/590 |
| 5,056,489 | 10/1991 | Lorraine | 123/468 |
| 5,533,486 | 7/1996 | Qutub . | |
| 5,601,066 | 2/1997 | Qutub . | |

*Primary Examiner*—A. Michael Chambers
*Attorney, Agent, or Firm*—Ingrid McTaggart

[57] ABSTRACT

A draw and return tube assembly having draw and return tubes welded to a flange at a first end and crossed over each other and welded together at a second end. The openings in the tubes opposite the flange are positioned a distance apart such that fuel returned to the tank through the return tube is not immediately redrawn into the draw tube. The ends of the tubes positioned opposite the flange have a cross sectional area that facilitates placement of the assembly through a flange receiving aperture in a fuel tank such that the assembly may be installed within the fuel tank after manufacturing thereof. Welding of the tubes at their ends opposite the fuel tank provides for a stable assembly without the use of a separate securing device.

20 Claims, 5 Drawing Sheets

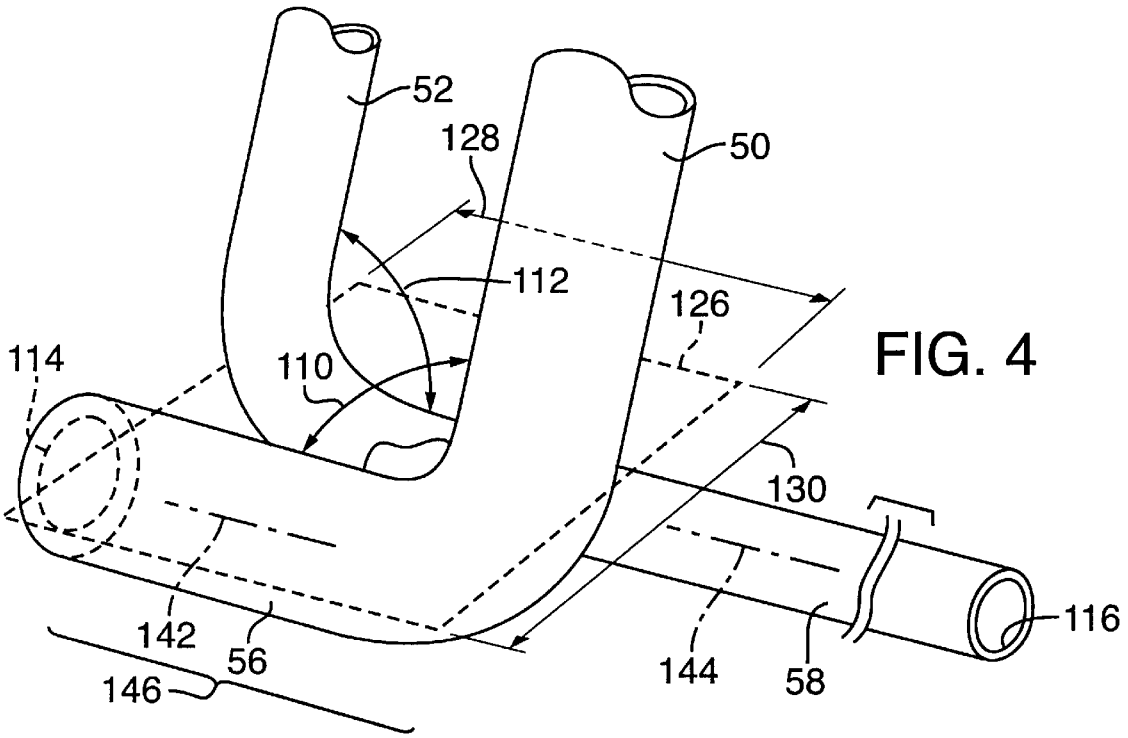
FIG. 4
FIG. 5
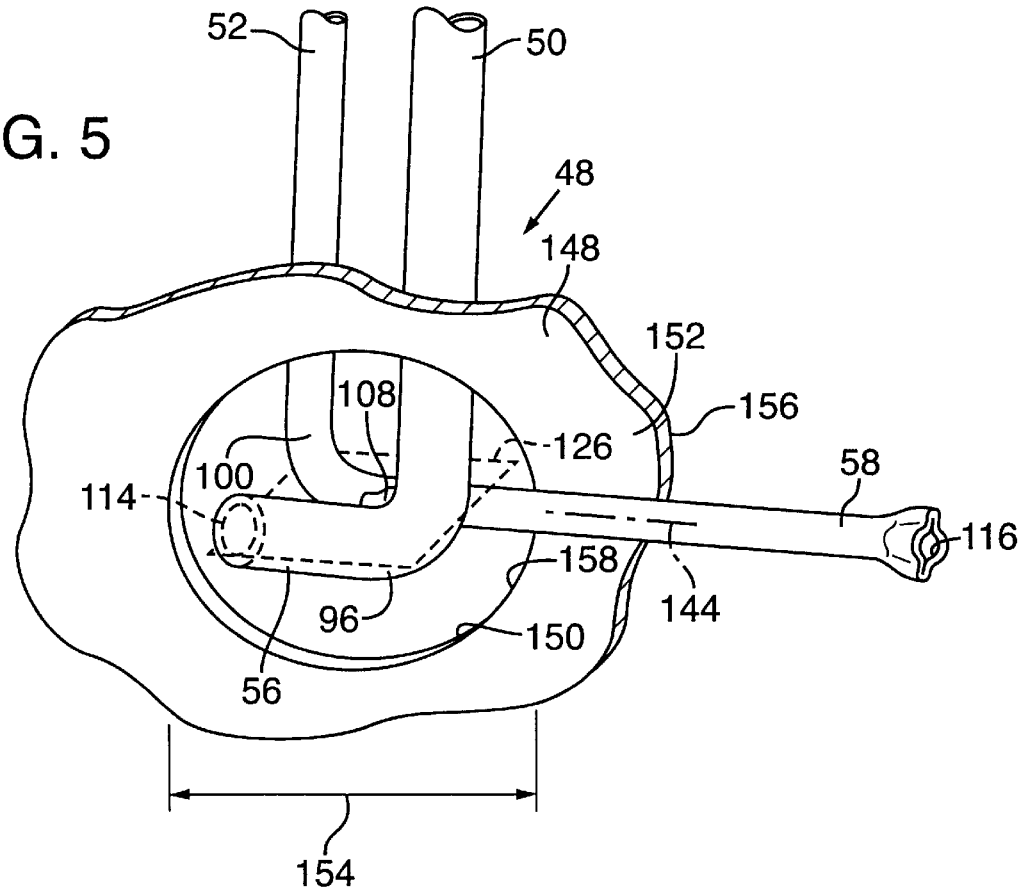

DRAW AND RETURN TUBE ASSEMBLY AND PROCESS OF MANUFACTURING THE SAME

TECHNICAL FIELD

The present invention relates to an improved fuel draw and return tube assembly, and process of manufacturing the same, for use in commercial vehicles, and more particularly, to an improved draw and return tube assembly for use in commercial vehicles wherein the draw and return tubes are crossed and welded to each other thereby defining a cross section which allows placement of the assembly through an aperture in a fully assembled fuel tank, and thereby stabilizing the assembly without the use of a bracket.

BACKGROUND OF THE INVENTION

The present invention is particularly intended for use on commercial vehicles, although it may be used with any internal combustion engine connected to a fuel tank having a draw and return tube assembly. In particular, diesel engines typically operate by drawing fuel from a fuel tank, combusting a portion of the fuel and then returning the unused, or uncombusted, fuel to the fuel tank. The volume of fuel returned to the fuel tank is dependent on engine power output, and generally is quite substantial. Accordingly, such draw and return tube assemblies play a vital role in the operation of diesel engines.

Heavy commercial vehicles frequently employ dual fuel tanks, also called saddle tanks, wherein fuel is drawn simultaneously from both tanks for combustion within the engine. To prevent uneven draw and return of the fuel, which may lead to air being drawn into the engine, fuel flow regulators, such as draw and return tube assemblies, typically are installed in each of the dual fuel tanks. One prior art draw and return tube assembly comprises draw and return tubes connected to a flange at one end and connected together by a bracket at another end opposite the flange. The flange typically is mounted at an aperture sized to receive the flange on an outside surface of the fuel tank such that the opposite, bracketed end of the tubes extends downwardly into fuel held within the lower portion of the tank. Draw and return lines from the engine are connected to the draw and return tubes at the flange.

The tube openings opposite the flange typically extend away from one another and are each positioned an equal distance from the flange so that the draw and return tube fuel openings are also each positioned an equal distance below the top surface of fuel held within the tank. In this arrangement, when the two saddle tanks and the corresponding draw and return tube assemblies are each positioned on the commercial vehicle, the pressure head of fuel positioned above the draw and return tube openings of each assembly will result in equal amounts of fuel being withdraw from each of the tanks and equal amounts of fuel being returned to each of the tanks. In addition, swedging or crimping of the end of the return tube opening opposite the flange will facilitate filling the return fuel line. This filling of the return fuel line enables a siphon effect between the left and right hand fuel tanks. Accordingly, the draw and return tube assemblies of the prior art act as passive flow regulators for ensuring equal levels of fuel drawn and returned to each of the two saddle fuel tanks.

Conventional draw and return tubes, at their ends opposite the flange, typically are bent at a ninety degree angle away from each other such that the open ends of the tubes opposite the flange are spaced apart from each other a distance of at least twelve inches and such that the return flow of fuel into the tank is in a direction opposite to the draw tube opening. Separation of the draw and return tube openings helps to ensure that heated and aerated fuel returned to the tank through the return tube is not immediately redrawn into the draw tube but is instead cooled and deareated by the remaining fuel held in the fuel tank.

This bent configuration of the draw and return tube assembly results in a cross section of the assembly that prohibits placement of the assembly through the flange-sized aperture of the tank once the tank has been manufactured. Accordingly, due to the large cross section of the assembly, assemblies of the prior art must be placed within an interior of the tank and installed therein prior to final assembly of the tank. Assembly of the tank, therefore, requires the step of partial completion of the tank, installation of the draw and return tube assembly, and then completion of the tank. This process can be quite time consuming and costly. Moreover, once installed, prior art draw and return tube assemblies cannot be removed or repaired if the assemblies become damaged or clogged. In addition, there is a variety of different sized draw and return tube assemblies that may be installed in a tank. Tank manufacturers may desire to have an inventory of fully assembled fuel tanks on hand wherein the desired size draw and return tube assembly is installed within a tank when requested by a customer. Installation of a draw and return tube assembly into a completed tank, in response to a request for a particular size draw and return tube assembly, is not feasible with the large cross section assemblies of the prior art.

The process of manufacturing a conventional draw and return tube assembly typically involves cutting the tubing to a particular length, bending the tubing at the ends opposite the flange, securing the tubing to the flange, and then stabilizing the assembly by placing a bracket on the tubes at the end opposite the flange. The bracket typically is a three-piece device having two clamp plates and a fastener, such as a rivet. The bracket is installed by placing the clamp plates around the tubes, placing the rivet through aligned apertures in the clamp plates and then fastening the plates in place by clinching the rivet. This can be a labor intensive and time consuming process. Moreover, during typical driving conditions for a commercial vehicle, the bracket may loosen on the tubes such that the bracket falls to the bottom of the fuel tank. Due to the permanent installation of the draw and return tube assembly, the assembly cannot be removed to repair the loosened bracket, thereby requiring replacement of the entire fuel tank.

Accordingly, there is a need for a draw and return tube assembly that may be installed within a fuel tank after the fuel tank has been completely manufactured. Moreover, there is a need for a draw and return tube assembly that does not include a bracket and which may be manufactured without the labor intensive step of securing such a bracket to the tubes.

SUMMARY OF THE INVENTION

The present invention provides an improved draw and return tube assembly, and a process of manufacturing the same, that overcomes the disadvantages of the prior art. One aspect of the present invention provides a draw and return tube assembly wherein the draw and return tubes are bent and crossed over each other such that a cross section of the assembly is relatively small. Accordingly, the assembly can be installed in a completely assembled fuel tank by placement of the assembly through a flange-sized aperture in the fuel tank. Another aspect of the present invention provides a method for manufacturing a draw and return tube assembly wherein the crossed draw and return tubes are welded to each other to stabilize the assembly such that a bracket is not required. Elimination of the bracket eliminates a labor intensive and time consuming processing step of the prior art and also reduces the number of parts required for manufacturing the assembly. In addition, elimination of the bracket increases the life of the product by reducing the possibility that components of the assembly may become loose during normal driving conditions.

These features are provided generally in a draw and return tube assembly having draw and return tubes welded to a flange at a first end and crossed over each other and welded together at a second end. The openings in the tubes opposite the flange are positioned a distance apart such that fuel returned to the tank through the return tube is not immediately redrawn into the draw tube. The ends of the tubes positioned opposite the flange have a cross section that facilitates placement of the assembly through a flange-sized aperture in a fuel tank such that the assembly may be installed within the fuel tank after manufacturing thereof. Welding of the tubes at their ends opposite the fuel tank provides for a stable assembly without the use of a bracket, as is required in prior art devices.

BRIEF DESCRIPTION OF THE DRAWINGS

FIG. 4 is a detailed isometric view of the weld and cross point of the draw and return tubes of FIG. 2;

FIG. 5 is an isometric view of the draw and return assembly of FIG. 2 during installation of the assembly into a fully assembled fuel tank.

DETAILED DESCRIPTION OF THE PREFERRED EMBODIMENTS

As has been mentioned, the invention provides a draw and return tube assembly that is intended for use on commercial vehicles, although it may be used with any internal combustion engine connected to a fuel tank requiring a draw and return tube assembly.

Figure 1:
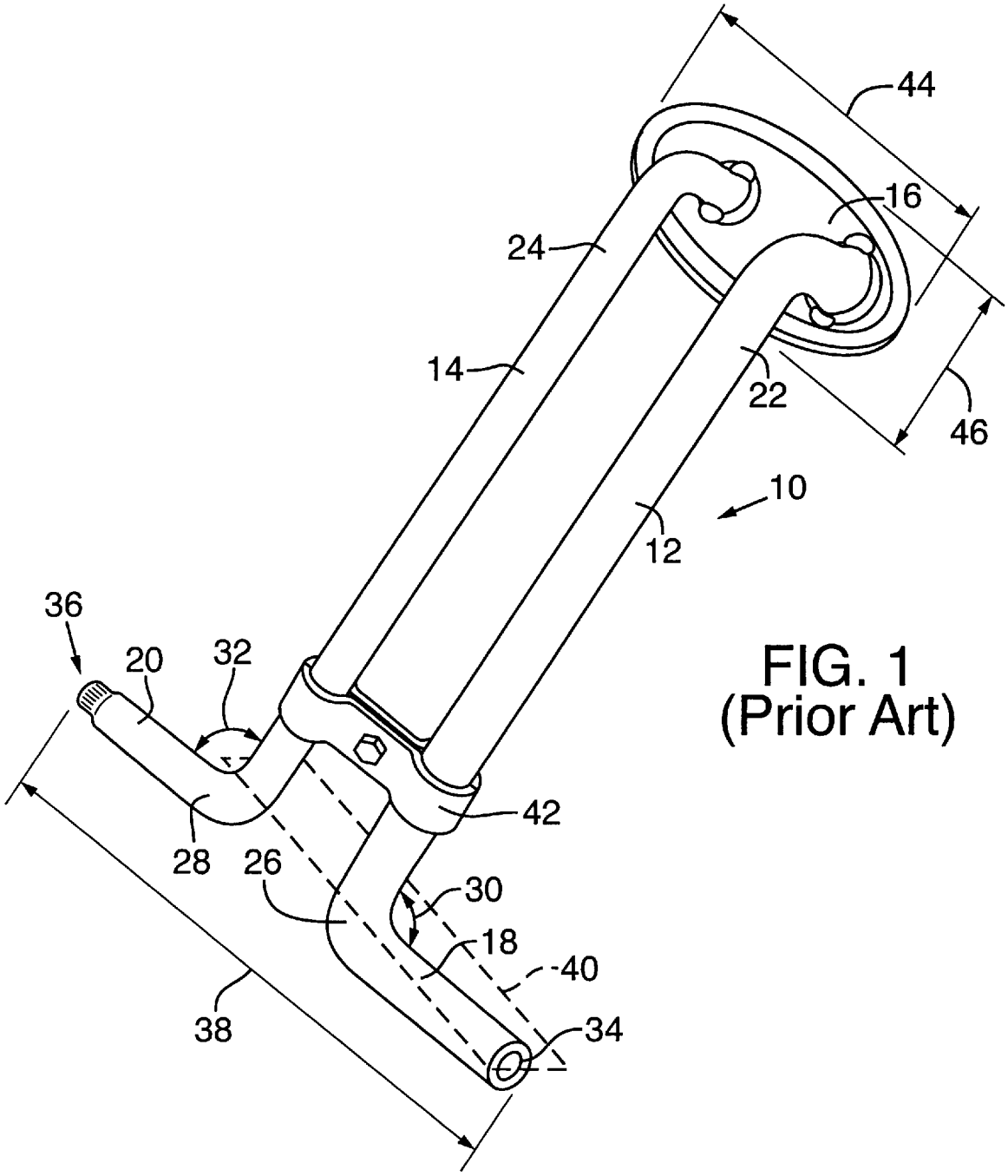
FIG. 1 (Prior Art)
FIG. 1 is an isometric view of a draw and return tube assembly of the prior art.

FIG. 1 shows a draw and return tube assembly 10 of the prior art including a draw tube 12, a return tube 14, and a flange 16 to which the tubes are welded. Each of the tubes has a first end 18 and 20, respectively, positioned opposite the flange and a second end 22 and 24, respectively, welded to the flange. The first end of the tubes each include a bend 26 and 28, respectively, defining an angle 30 and 32, respectively, of approximately ninety degrees. In this configuration, fuel openings 34 and 36 of the tubes extend in opposite directions and are positioned apart a distance 38 of approximately twelve inches (in) (30 centimeters (cm)). Each of the tubes has a diameter in the range of approximately one ½ to 1½ inches (1.3 to 3.8 cm) Accordingly, the assembly defines a minimum cross sectional area 40 of approximately 8 in (20 cm) by 1½ in (3.8 cm), for placement through a flange receiving aperture (not shown) of a fuel tank. A bracket 42 typically secures the tubes together at ends 18 and 20 opposite the flange.

Still referring to FIG. 1, flange 16 has a length 44 of approximately 5 in (12.5 cm) and a width 46 of approximately 2½ in (6.3 cm). The flange typically is welded around the edge of a flange receiving aperture (not shown) of a fuel tank wherein the flange receiving aperture typically has dimensions of approximately 4½ in (11.25 cm) by 2 in (5 cm). Assembly 10 of the prior art, therefore, having minimum cross sectional area 40 of approximately 8 in (20 cm) by 1½ in (3.8 cm), can only be placed through the flange receiving aperture from the inside of the tank for installation on the tank. The assemblies of the prior art, therefore, must be installed in fuel tanks prior to complete assembly of the tanks.

Figure 2:
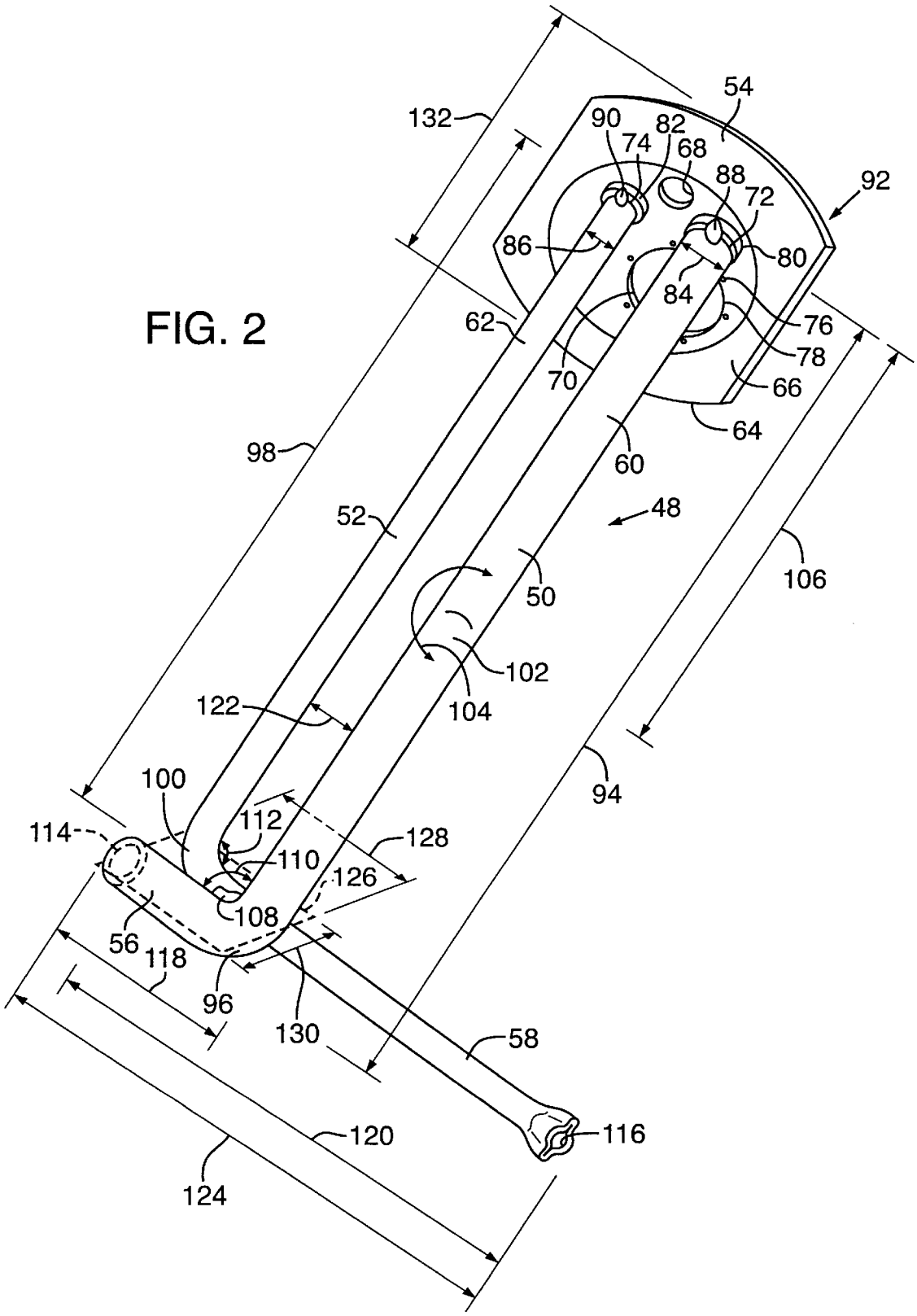
FIG. 2 is an isometric view of the draw and return tube assembly of the present invention.

FIG. 2 shows a draw and return tube assembly 48 of the present invention including a draw tube 50, a return tube 52, and a flange 54 to which the tubes are welded. Each of the tubes has a first end 56 and 58, respectively, positioned opposite the flange and a second end 60 and 62, respectively, welded to the flange. Flange 54 includes a generally circular outer edge 64, an underside surface 66, and apertures 68, 70, 72 and 74 extending therethrough. Apertures 68 and 70 are sized and positioned with respect to each other so as to receive therein a fuel-sending unit as known in the art. Aperture 70 typically includes five apertures 76 equally spaced around a circumference 78 of aperture 70 so as to receive fasteners therein for securing the fuel-sending unit to the flange. The fuel-sending unit plays no part of the present invention and, therefore, has not been shown. The flange may be configured to receive other tank components such as tank vents, thereby further integrating and simplifying manufacture of the tank.

Still referring to FIG. 2, apertures 72 and 74 each include a raised lip 80 and 82, respectively, extending outwardly from surface 66 for facilitating placement of the second end of draw and return tubes 50 and 52 within the apertures and welding of the tubes thereto. In the preferred embodiment aperture 72 has a diameter 84 of approximately 1 in (2.5 cm) and aperture 74 has a diameter 86 of approximately ¾ in (1.9 cm). These diameters correspond to the diameters of the tubes secured therein. Tubes 50 and 52 may first be secured to underside surface 66 of the flange with welds 88 and 90 which are used to hold the tubes in place during the finishing welding step wherein the tubes are welded around their diameter to an upper, outwardly facing surface 92 of the flange. After being welded to the flange the tubes may be machined to define threads on an inner surface of the tubes in second end regions 60 and 62 of the tubes adjacent the flange. The threads (not shown) facilitate connection of draw and return lines from the engine to the draw and return tubes.

Draw tube 50 has a length 94 of approximately 24 in (60 cm), measured from the flange to a bend region 96 of first end region 56 of the draw tube. Return tube 52 also has a length 98 of approximately 24 in (60 cm), measured from the flange to a bend region 100 of first end region 58 of the return tube. Tube length varies as needed to fit various size fuel tanks. The tubes extend parallel to each other from the flange to a second bend region 102 of draw tube 50 at which point bend 102 defines an angle 104 of approximately one hundred and seventy five degrees. The angle may be in the range of one hundred and fifty degrees to two hundred and ten degrees, or any other angle as is required. Bend region 102 is positioned a distance 106 of approximately 14½ in (36.3 cm) from flange 54 and facilitates the overlapping of draw tube 50 and return tube 52 in their first end regions opposite the flange. Accordingly, draw tube 50 overlaps and is welded to return tube 52 with a weld 108 to secure the tubes together. A bracket, therefore, is not required to stabilize the draw and return tube assembly of the present invention.

Bend 96 of draw tube 50 defines an angle 110 of approximately ninety degrees and bend 100 of return tube 52 defines an angle 112 also approximately ninety degrees such that openings 114 and 116, respectively, of the draw and return tubes are positioned facing opposite directions. Angles 110 and 112 may be in the range of seventy degrees to one hundred degrees, or any angle as is required. Draw tube 50 has length 118 of approximately 4½ in (11.3 cm) extending from bend 96 to opening 114, return tube 52 has a length 120 of approximately 11 in (27.5 cm) extending from bend 100 to opening 116, and the tubes are spaced apart a distance 122 of approximately 2 in (5 cm) along their length extending from flange 54. Accordingly, in this configuration, openings 114 and 116 of the tubes are spaced apart a distance 124 of approximately 12 in (30 cm). Return tube 52 may be crimped or swedged at opening 116, as known in the art. Those skilled in the art will understand, of course, that the flange and tubes of the present invention may be manufactured in any size as required for a particular use. In the preferred embodiment, tubes 50 and 52, and flange 54 are manufactured of aluminum. Any suitable material may be used, however, including other metals and any suitable man made materials such as plastics.

Distance 124 between the draw tube opening and the return tube opening is the same linear spacing distance found in prior draw and return tube assemblies. The crossed tube arrangement of the present invention, however, provides a much smaller cross sectional area 126 of the assembly for placement through a flange receiving aperture in an assembled fuel tank, than the assemblies of the prior art. Specifically, cross sectional area 126 has a length 128 of approximately 4¼ in (10.6 cm) and a width 130 of approximately 2 in (5 cm). These dimensions allow placement of first ends 56 and 58 of tubes 50 and 52, respectively, of the assembly through a flange receiving aperture in a completely assembly fuel tank, the aperture having dimensions of approximately 4½ in (10.6 cm) by 2 in (5 cm). Those skilled in the art will understand that tubes of different diameters and lengths may be used such that cross sectional area 126 may have lengths as great as 10 in (25 cm) and widths as great as 5 in (12.5 cm) for use in larger fuel tanks having larger flange receiving openings.

Still referring to FIG. 2, flange 54 of the present invention has a diameter 132 of approximately 7 in (17.5 cm). Accordingly, a flange receiving aperture sized to receive flange 54 typically will have a diameter of approximately 6 in (15 cm). Minimum cross sectional area 126 of assembly 48 is easily received within such an aperture. Accordingly, the configuration of the present invention facilitates installation of the draw and return tube assembly within a fully assembled fuel tank. The configuration also allows for removal of the draw and return tube assembly from a tank for repair or replacement, without replacement of the entire fuel tank, when the assembly is removably bolted to the fuel tank.

Figure 3:
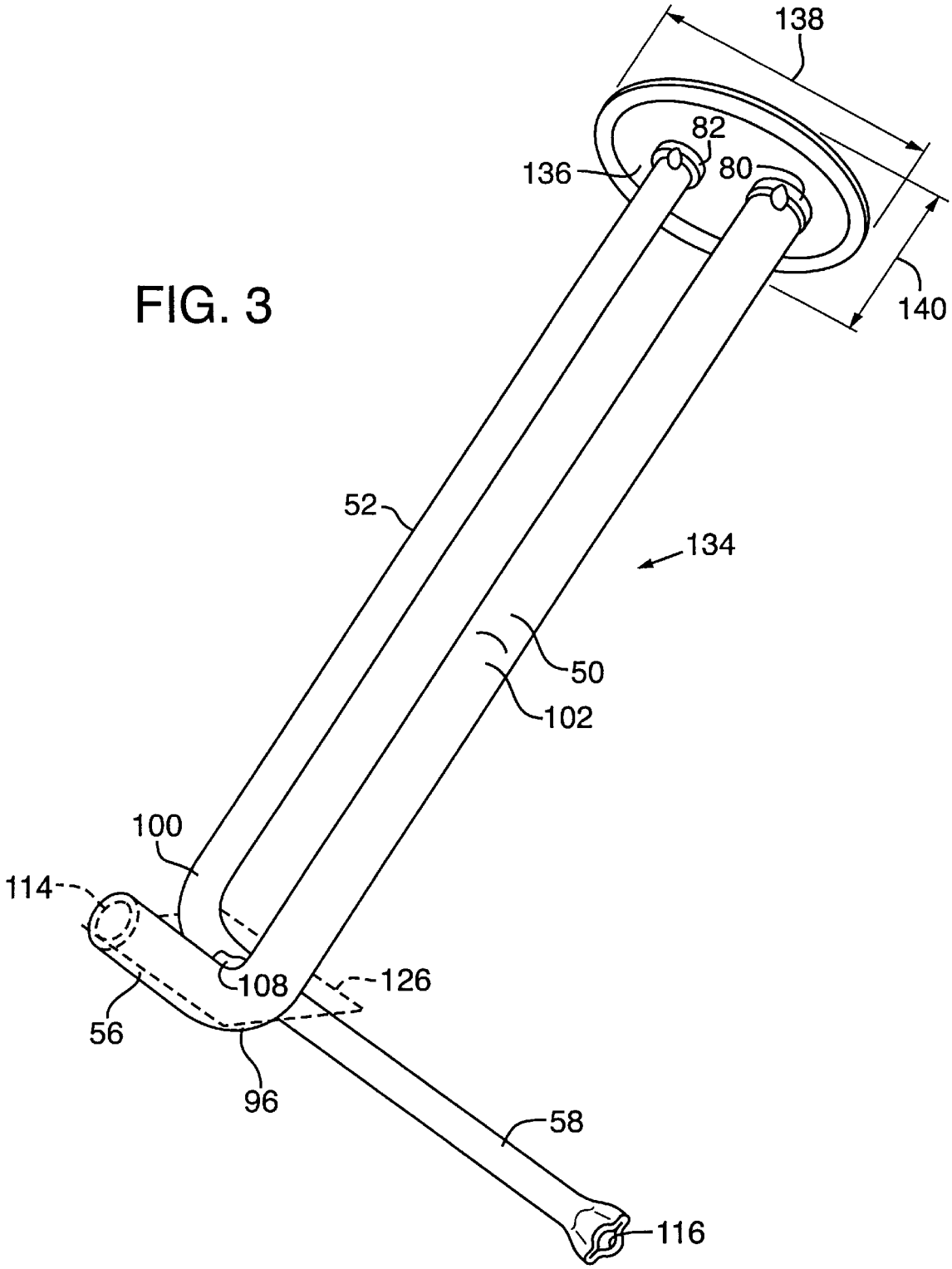
FIG. 3 is an isometric view of another embodiment of the draw and return tube assembly of the present invention.

FIG. 3 shows another draw and return tube assembly 134 of the present invention having a flange 136. Flange 136 is similar in size and shape to the flanges of the prior art in that the flange does not include apertures sized or positioned for receiving a fuel-sending unit. Accordingly, flange 136 has a length 138 of approximately 5 in (12.5 cm) and a width 140 of approximately 2½ in (6.3 cm). This flange typically is secured around the edge of a flange receiving aperture (not shown) having dimensions of approximately 4½ in (10.6 cm) by 2 in (5 cm). Minimum cross sectional area 126 of the assembly, therefore, having dimensions of approximately 4¼ in (10.6 cm) by 2 in (5 cm), can be placed through such a flange receiving aperture sized to receive flange 136.

FIG. 4 shows a detailed view of the weld and cross point of draw and return tubes 50 and 52. In the preferred embodiment, first end region 56 of draw tube 50 defines an axis 142 which is parallel to an axis 144 of first end region 58 of return tube 52. In this configuration, the end regions of the tubes are parallel to each other in an overlap region 146. In other embodiments the axes of the end regions may not be parallel to each other. Weld 108 typically is positioned between and contacting the tubes within overlap region 146. Due to the crossed nature of the tubes, minimum cross sectional area 126 may easily be placed through a flange receiving aperture, as further described below.

FIG. 5 shows assembly 48 during installation of the assembly into a fully assembled fuel tank 148 having a flange receiving aperture 150 therein. Only a portion of the tank has been shown for ease of understanding. Tank 148 typically is cylindrically shaped and has an upper inside surface 152 through which aperture 150 extends. The tank typically is manufactured of aluminum and has a length of approximately 24 in (60 cm) and a diameter of approximately 18 in (45 cm). In the preferred embodiment, wherein flange 54, shown in FIG. 2, is secured to tank, aperture 150 has a diameter 154 of approximately 6½ in (16.3 cm) such that the flange is positioned against an outside surface 156 of the tank and is welded thereto. Installation of the draw and return tube assembly will now be described.

First end region 58 of return tube 52 of the assembly is placed into flange receiving aperture 150 until bend region 96 of return tube 50 is positioned adjacent an edge 158 of aperture 150 and such that axis 144 of the return tube is positioned approximately parallel to upper inside surface 152 of the tank. In this position, as shown, minimum cross sectional area 126 of assembly 48 is generally aligned with flange receiving aperture 150 such that bend region 96 of draw tube 50 can be placed through the aperture. Once bend regions 96 and 100 of the tubes have passed through aperture 150 of the tank, the remainder of the length of the tubes are extended through the aperture such that flange 54 contacts outside surface 156 of the tank. The flange is then secured to the tank by welding or by any other means as known in the art.

Figure 6:
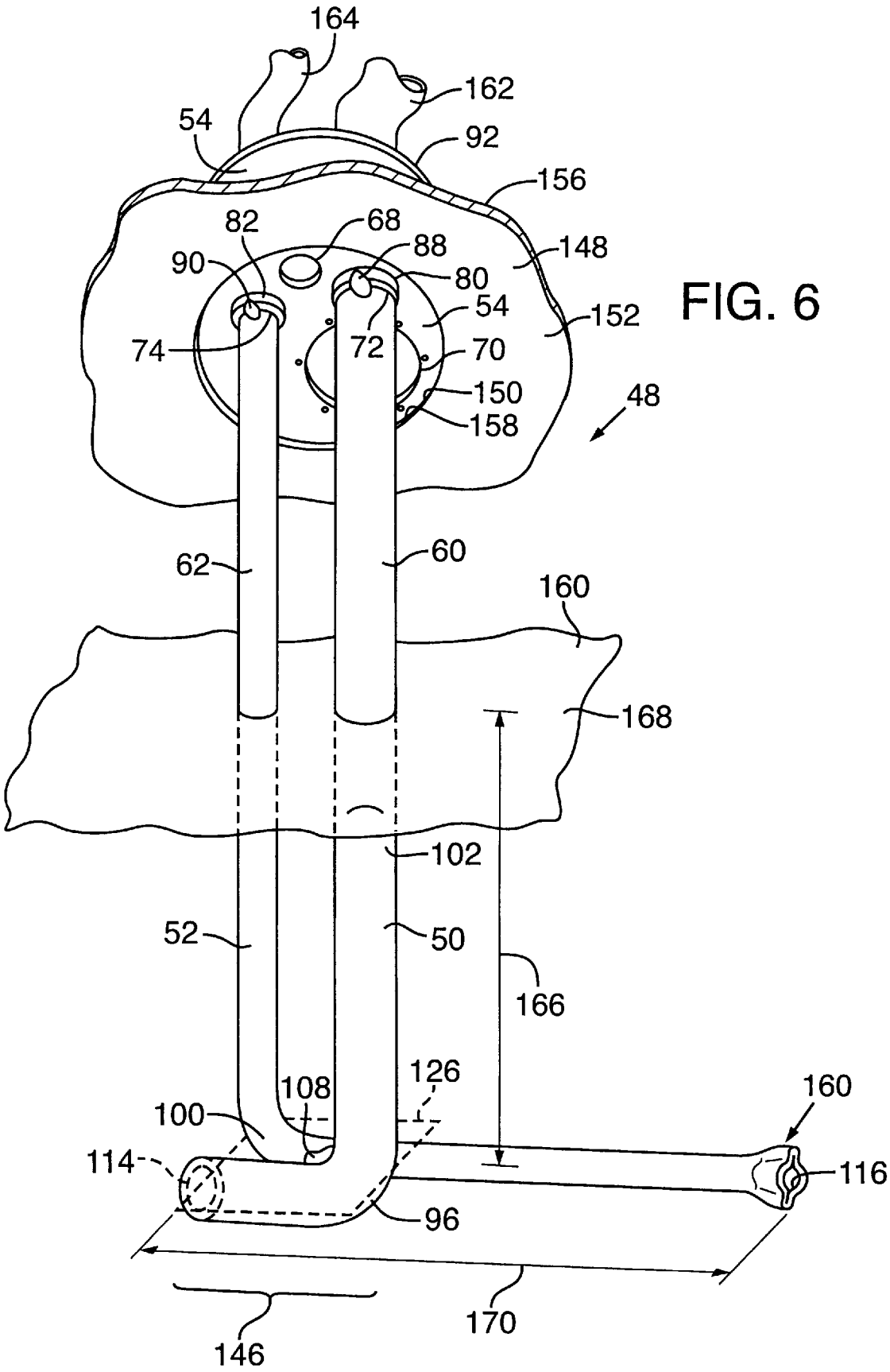
FIG. 6 is an isometric view of the draw and return tube assembly of FIG. 2 shown installed within a fuel tank and connected to draw and return fuel lines.

FIG. 6 shows draw and return tube assembly 48 installed within fuel tank 148 containing fuel 160 therein. Opening 116 of return tube 52 has a crimped region 160 to constrict the tube opening. In other embodiments, opening 116 may be swedged to constrict the tube opening. This swedging or crimping of the end of the return tube will facilitate filling of the return fuel line thereby enabling a siphon effect between the left and right fuel tanks.

Still referring to FIG. 6, a draw line 162 and a return line 164 extend to the engine and are connected to draw and return tubes 50 and 52, respectively, at flange 54. Openings 114 and 116 opposite the flange are each positioned an equal distance 166 below a surface 168 of fuel 160 such that the same pressure head acts on each of the draw and return tubes. Openings 114 and 116 are positioned facing opposite directions, and are spaced apart a distance 170, such that warm fuel returned to the tank is not immediately redrawn into tube 50 but instead may be cooled by the remainder of fuel held within the tank.

Similarly, in a preferred installment, the draw and return lines extending from the engine are connected by tee fittings to another saddle tank positioned on an opposite side of the commercial vehicle. Accordingly, the pressure head acting on the assemblies within each of the tanks causes the two draw and return tube assemblies to act as passive flow regulators. In addition, the siphoning action previously described ensures equal levels of fuel at all times in each of the two saddle fuel tanks.

The process of manufacturing the assembly will now be described. Tubes 50 and 52 are first manufactured in the desired predetermined size or diameter and are then cut to their predetermined lengths. Draw tube 50 is then bent in regions 96 and 102 to the desired predetermined angles. Return tube 52 is then bent in region 100 to its predetermined angle and first end 58 is crimped. The tubes are then placed within raised lips 80 and 82 of apertures 72 and 74 of flange 54, wherein the raised lips and apertures have been sized to receive the tubes therein. The tubes are then rotated within the apertures such that bend regions 96 and 100 of the tubes are positioned adjacent to and cross over one another. The tubes may then be welded to the raised lips by welds 88 and 90, to secure the tubes in place. The tubes are next welded together in overlapping region 146 by weld 108 thereby defining minimum cross sectional area 126. The tubes are then welded around their diameter to upper surface 92 of flange 54 to create an airtight seal. The first ends of the assembly are then placed through flange receiving aperture 150 of the tank and the remainder of the length of the tubes are extended into the tank. Flange 54 is then welded or otherwise secured to outside surface 156 of the tank. At this time, a fuel-sending unit (not shown) may be installed within apertures 68 and 70. The tank may then be installed on a truck and draw and return tube lines 162 and 164 connected to draw and return tubes 50 and 52.

In the above description numerous details have been set forth in order to provide a more through understanding of the present invention. It will be obvious, however, to one skilled in the art that the present invention may be practiced using other equivalent designs.

We claim:

1. A method of manufacturing a draw and return tube assembly comprising:

cutting a draw tube to a predetermined length;

cutting a return tube to a predetermined length;

bending the draw tube to define a first bend therein;

bending the return tube to define a first bend therein;

positioning the draw and return tubes adjacent a flange such that the first bend of the draw tube overlaps the first bend of the return tube;

securing the draw tube to the flange;

securing the return to tube to the flange; and securing the draw tube to the return tube at a position where the draw tube overlaps the return tube.

2. The method of manufacturing a draw and return tube assembly of claim 1 wherein the step of securing the draw tube to the return tube comprises welding.

3. The method of manufacturing a draw and return tube assembly of claim 1 wherein the step of bending the draw tube to define a first bend comprises bending the draw tube at a position approximately four inches from an end of the tube.

4. A draw and return tube assembly comprising:

a flange;

a first tube having a first end region secured to said flange and a second end region having a bend positioned therein; and a second tube having a first end region secured to said flange and a second end region having a bend positioned therein, said second end region of the second tube overlapping and being secured to said second end region of the first tube.

5. The draw and return tube assembly of claim 4 wherein the second end region of the second tube and the second end region of the first tube define a cross sectional area having a length less than ten inches and a width less than five inches.

6. The draw and return tube assembly of claim 4 wherein the second end region of the second tube overlaps the second end region of the first tube and defines a cross sectional area having a length less than five inches and a width less than three inches.

7. The draw and return tube assembly of claim 4 wherein the bend of the first tube defines an angle of approximately ninety degrees.

8. The draw and return tube assembly of claim 4 wherein the bend of the second tube defines an angle of approximately ninety degrees.

9. The draw and return tube assembly of claim 4 wherein the second end region of the first tube defines an opening facing a first direction, the second end region of the second tube defines an opening facing a second direction, and the first direction is opposite the second direction.

10. The draw and return tube assembly of claim 4 wherein the second end region of the first tube defines a first axis, the second end region of the second tube defines a second axis, and wherein the first axis is parallel to the second axis.

11. The draw and return tube assembly of claim 4 wherein the first tube further comprises a second bend defining an angle of approximately one hundred and seventy five degrees.

12. The draw and return tube assembly of claim 4 wherein the first tube is a draw tube and the second tube is a return tube.

13. The draw and return tube assembly of claim 4 wherein the first and second tubes extend from the flange in a generally parallel arrangement.

14. A draw and return tube assembly for installation within a fuel tank, comprising:

a flange having first and second apertures extending therethrough;

a draw tube having a first end region secured within said first aperture of the flange and a second end region having a bend positioned therein; and a return tube having a first end region secured within said second aperture of the flange and a second end region having a bend positioned therein, said second end region of the return tube overlapping and being secured to said second end region of the draw tube.

15. The draw and return tube assembly of claim 14 wherein the second end region of the return tube is secured to the second end region of the draw tube by a weld.

16. The draw and return tube assembly of claim 14 wherein the second end region of the return tube and the second end region of the draw tube define a cross sectional area having a length less than ten inches and a width less than five inches.

17. The draw and return tube assembly of claim 14 wherein the bend of the draw tube defines an angle of approximately ninety degrees and wherein the bend of the return tube defines an angle of approximately ninety degrees.

18. The draw and return tube assembly of claim 14 wherein the second end region of the draw tube defines an opening facing a first direction, the second end region of the return tube defines an opening facing a second direction, and the first direction is opposite the second direction.

19. The draw and return tube assembly of claim 14 wherein the second end region of the first tube defines a first axis, the second end region of the second tube defines a second axis, and wherein the first axis is parallel to the second axis.

20. The draw and return tube assembly of claim 14 wherein the draw tube further comprises a second bend defining an angle of approximately one hundred and seventy five degrees.

* * * * *